US010448175B2

(12) United States Patent
Huber et al.

(10) Patent No.: US 10,448,175 B2
(45) Date of Patent: Oct. 15, 2019

(54) HEARING AID WITH A FLEXIBLE COMPRESSION ELEMENT

(71) Applicant: Oticon A/S, Smørum (DK)

(72) Inventors: Christian Huber, Berne (CH); Patrick Walther, Berne (CH); Robert Michler, Berne (CH)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 15/891,566

(22) Filed: Feb. 8, 2018

(65) Prior Publication Data

US 2018/0227685 A1 Aug. 9, 2018

(30) Foreign Application Priority Data

Feb. 9, 2017 (EP) ..... 17155375

(51) Int. Cl.
*H04R 25/00* (2006.01)

(52) U.S. Cl.
CPC ..... *H04R 25/602* (2013.01); *H04R 25/65* (2013.01); *H04R 25/558* (2013.01); *H04R 2225/025* (2013.01)

(58) Field of Classification Search
CPC .... H04R 25/65; H04R 26/558; H04R 25/602; H04R 2225/025
See application file for complete search history.

(56) References Cited

U.S. PATENT DOCUMENTS 4,941,180 A 7/1990 Buettner
4,947,439 A * 8/1990 Buettner ..... H04R 25/602 381/323
2009/0074221 A1* 3/2009 Westermann ..... H04R 25/65 381/327

OTHER PUBLICATIONS

Shore Hardness Chart, Retrieved Mar. 18, 2019, Smooth-On, Inc. https://www.smooth-on.com/page/durometer-shore-hardness-scale/.*

* cited by examiner

*Primary Examiner* — Brian Ensey
(74) *Attorney, Agent, or Firm* — Birch, Stewart, Kolasch & Birch, LLP

(57) ABSTRACT

A hearing device having a construction configured to minimize internal noise components of the hearing device is disclosed. In more detail, a hearing device, such as a hearing aid comprising a battery and a compartment configured for receiving a battery is disclosed, wherein the construction of the hearing aid housing is configured such that the noise components arising from the battery being in contact with a battery spring is substantially minimized.

20 Claims, 5 Drawing Sheets

HEARING AID WITH A FLEXIBLE COMPRESSION ELEMENT

FIELD

The present disclosure relates to a hearing device, such as a hearing aid, comprising a flexible compression element. More particularly, the disclosure relates to a hearing device, which is configured to reduce noise arising in internal elements of a hearing device.

BACKGROUND

A hearing device, such as a hearing aid is generally known to be powered by a battery, where the battery is substantially housed in a battery compartment of the hearing device. In order to power the different electrical components of the hearing device, the battery is connected to one or more battery springs, which provides electrical connections between the battery and the electrical components of the hearing device.

In a hearing device, the connection with the one or more battery springs creates a current in the electrical components of the hearing device, which current may cause a series of unwanted noise components influencing the acoustics of the hearing device. Such noise components should preferably be accounted for, when designing a hearing device in order to improve the quality and functionality of the hearing aid. As an example, it is known that the current created from the battery connection with the battery springs, may create an unwanted signal in e.g. a telecoil of a hearing aid.

However, constructional limitations to the battery spring design in view of different battery sizes exist. That is, batteries are not made to precision tolerances in view of especially size, and furthermore batteries may expand and contract during charge and discharge.

Accordingly, upon designing the hearing device, it should be made sure that such precision tolerances are taken into account in order to assure a sufficient and reliable contact with the batter springs, no matter the tolerance differences of the batteries used.

Therefore, it is object to provide a hearing aid solution allowing for an improved hearing aid, which fulfill a need to limit noise components, while at the same take into account differences in battery precision tolerance in the hearing aid to provide an improved quality of the hearing aid.

SUMMARY

This and further objects are achieved by a hearing device comprising a housing having at least a first shell structure, and a compartment configured to be arranged in a pivotal connection with the at least first shell structure, wherein the compartment having a center point is configured to receive and house a battery for powering said hearing device. The hearing aid further comprising at least one first contact element configured to contact the battery when the battery is received in the battery compartment and moved into a closed position of the compartment, wherein the hearing device further comprises a flexible compression element. The flexible compression element is provided in connection with the at least first shell structure and/or in connection with the compartment and configured to act on the battery when the compartment is moved from an open to a closed position.

With such a hearing device construction, it is ensured that any battery tolerances are accounted for while at the same time noise components introduced due to the mechanical connection between a battery and contact elements of a hearing device is reduced. That is, with the configuration of a flexible compression element according to embodiments of the disclosure, a force acting on the battery from a contact element is counteracted by a force from the flexible compression element acting on the battery from the other side than the contact element.

It should be noted that the flexible compression element as described herein is substantially made from a non-conductive material, and is not configured to transmit power from the battery to the electronic components of the hearing aid. Rather the flexible compression element is configured to provide a "push" towards the battery on a curved surface thereof, wherein the curved surface of the battery to which the flexible compression element pushes is substantially opposite to a second curved surface of the battery to which a contact element (i.e. a battery spring) contacts the battery.

Accordingly, it should be understood that the flexible compression element is as such not a battery springs, which transfers electric energy.

Accordingly, in an embodiment, the hearing device is configured with a flexible compression element, which comprises a leg element provided in the first shell structure or in the compartment, and a supporting member, wherein the leg element is configured to receive the supporting member so as to maintain the supporting member in a position inside the housing. This allows the supporting member, to be efficiently and securely arranged in the first shell structure or the compartment. It should be noted that the leg element and the supporting member is preferably arranged in the first shell structure, since an efficient counteraction of the force from the contact element is achieved with this construction, while at the same time, the contact element aids in ensuring that the compartment is kept in a closed position.

In an embodiment, the at least one contact element is arranged in the first shell structure in a first end positioned opposite to the flexible compression element, where the at least one contact element acts on the battery with a force (F1) and the flexible compression element is configured to counteract said first force (F1).

In an embodiment, the first shell structure may comprise a top surface, where the first leg element extends from the top surface in a direction towards the center point of said compartment in a substantially L-shaped manner. Accordingly, the first leg element may form an integrated part of the first shell structure, such that it is formed directly in the shell structure during production. Accordingly, only the supporting member is detachable connected with the shell structure, which allow a change of the supporting member, when the flexibility and compression ability thereof is reduced due to tear and wear. The L-shaping of the leg-element ensures that the supporting member is inserted in a secure manner in the shell structure of the hearing aid and also ensures that the correct alignment of the support member is achieved in relation to cancel out the force arising from the contact element.

Accordingly, in an embodiment the at least one contact element creates a force vector F1 in a direction from an end point of the contact element to the center point of the compartment, and the flexible compression element creates a force vector F2 in a direction from an end point of the supporting member to the center point of the compartment, wherein the force vectors F1, F2 of the contact element and said flexible compression element, respectively, are configured to cancel out each other.

In an embodiment the flexible compression element is made from a material providing a size of the force vector F2 sufficient to cancel out said force vector F1 arising from the at least one contact element. This may be achieved by an embodiment, where the supporting member is made from a rubber or silicone material; preferably said material comprises a rubber shore durometer hardness chosen from the range 40 A to 80 A, 40 A to 50 A, 50 A to 60 A or 60 A to 70 A or 70 A to 80 A.

The hearing device may in an embodiment be configured with a compartment, which comprises a bottom surface, from which bottom surface a protruding element extends so as to be received in the housing in a closed position of the compartment, wherein the protruding element is configured to receive said flexible compression element in an opening provided in said protruding element. Thereby, it is ensured that a guided closure of the compartment in the housing is achieved, while the leg-element is kept in place to ensure the correct force creation to counteract the force from the contact element.

In order to keep the supporting member in position in the hearing device shell structure, the at least first shell structure may in an embodiment comprise a side structure, which side structure abuts a second end of the supporting member, wherein the first end of the supporting member is arranged to abut a part of the leg element. In this way, the leg element and the side of the shell structure creates a space wherein the supporting element is arranged and maintained in the shell structure to ensure the correct counteracting force.

For obtaining a sufficient counteraction of the force created by the contact element onto the battery, the supporting member may be constructed with a base part and a substantially angled part extending from said base part. With the arrangement of the supporting element in the flexible compression element with the angled part extending towards a center point of the compartment it is ensured that a force vector directed towards the center point is created allowing a counteracting force. Furthermore, this constructions ensures that the compartment are kept in a closed position, where the battery may not be pushed out of the compartment by the force arising from the contact element.

In more detail, the base part may in an embodiment be configured to abut the side structure of the shell structure, and the angled part extends from the base part, so as to form an angled protrusion having a centerline extending in a direction towards the center point of said compartment.

In a further embodiment the opening in the protruding element is formed from two substantially leg shaped extensions, which are separated a distance from each other so as to be configured to receive the flexible compression element in said opening in a closed position of said compartment. In this way an efficient guidance of the compartment into a closed position is achieved. At the same time the leg shaped extensions and the opening therein ensures that the leg element and the supporting member is kept in place in the shell structure and compartment.

The hearing device may furthermore in an embodiment comprise a second contact element, wherein the first contact element is configured to engage the battery in a rounded surface thereof, and the second contact element is configured to engage said battery at a flat surface area thereof.

In yet a further embodiment, the hearing device may comprise a coil element, wherein the coil element is arranged in the shell structure at an end opposite to the first contact element, where a coil element axis runs substantially parallel with a longitudinal centerline of the first and second contact element.

BRIEF DESCRIPTION OF DRAWINGS

The embodiments of the disclosure may be best understood from the following detailed description taken in conjunction with the accompanying figures. The figures are schematic and simplified for clarity, and they just show details to improve the understanding of the disclosure, while other details are left out. Throughout, the same reference numerals are used for identical or corresponding parts. The individual features of each embodiment may each be combined with any or all features of the other embodiments. These and other embodiments, features and/or technical effect will be apparent from and elucidated with reference to the illustrations described hereinafter in which.

DETAILED DESCRIPTION

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the device or apparatus, and methods are described by various functional units, modules, components, steps etc. (collectively referred to as "elements"). Depending upon particular application, design constraints or other reasons, these elements may be implemented using electronic hardware, computer program, or any combination thereof.

Figure 1:
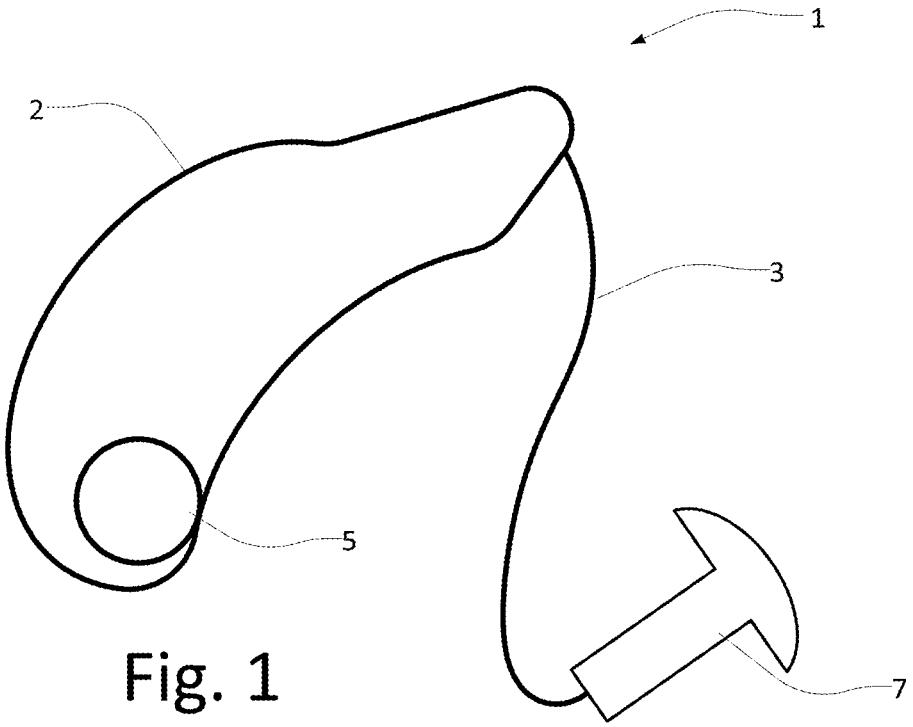
FIG. 1 illustrate schematically an example of a hearing aid construction.

A hearing device, such as a hearing aid 1 illustrated in FIG. 1 is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears through an earpiece 7 of the hearing aid. The "hearing device", preferably a hearing aid, may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be worn in any known way. This may include i) arranging a unit of the hearing device behind the ear (e.g. the housing 2, illustrated in FIG. 1) with a tube (e.g. tube 3 illustrated in FIG. 1) leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant, or iv) arranging a unit of the hearing device as an entirely or partly implanted unit such as in Bone Anchored Hearing Aid or Cochlear Implant.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal.

Referring initially to FIG. 1, a general schematic view of a behind the ear type hearing aid 1, where the receiver may be arranged either in the housing 2 or in the earpiece 7 is illustrated. The hearing aid 1 comprises a housing 2, which encloses electronics of the hearing aid 1. The electronics may include all electronics of a hearing aid, such as microphones, printed circuit boards having electronic components mounted thereon, telecoils and other elements. As mentioned, the receiver may be arranged in the earpiece 7 or in the housing 2. The hearing aid 1 further comprises a battery 5 for powering the internal electronics of the hearing aid 1. The battery 5 is arranged in a compartment (not shown), also denoted a battery compartment, substantially forming part of a battery drawer.

In one embodiment the hearing aid 1, is provided with a tube 3, which is configured to guide sound and/or electrical connections to an earpiece 7 configured to be inserted into a an ear canal of a hearing aid user. In case of the receiver arranged in the earpiece 7, the tube 3 is configured to guide electrical connections to the receiver and in an alternative embodiment, where the receiver is arranged in the housing 2, the tube 3 is configured to guide sound from the receiver to the earpiece 7.

The battery 5 of the hearing aid 1 is situated in the housing 2, usually by the configuration of a compartment in a battery drawer, which is pivotably connected to at least a part of the housing 2 structure. The battery 5, when arranged in the housing 2 connects with a contact element (more particularly a battery spring) for generating an electrical power to the internal electronics of the hearing aid. This electrical connection may introduce unwanted currents (i.e. noise components) travelling onto other electrical components of the hearing aids, which as previously described may be considered as unwanted noise components disturbing e.g. the signals of a telecoil, receiver, microphones or other electronic components of the hearing aid.

The amount of the electrical current introduced by the contact between the contact element and the battery depends partly on the contact element design and size, since a large surface area of the contact element creates a large surface area on which an electrical current may flow and consequently cause a larger noise component in the hearing aid. Accordingly, to reduce the noise component introduced, the size of the contact element should be considered. However, such change in the construction of the contact element may due to minimum and maximum battery tolerances influence (i.e. previously mentioned precision tolerances) the point of contact between the battery and the contact element, which is needed to provide sufficient power to a hearing aid.

Batteries are produced in different sizes having a minimum and a maximum precision tolerance, which preferably should fit into any battery compartment, no matter the degree of tolerance of the battery. Accordingly, if considering a re-design of e.g. the contact element of the hearing aid in order to limit the noise introduced into the hearing aid electronics, a risk of creating a free space, which is too big for the battery to keep contact with the contact element arises. These considerations have been taken into account in the embodiments of the disclosure in order to solve the need for a hearing aid construction that allows for a reduction of the noise components introduced by the current from the battery without compromising the tolerances of the batteries used. Accordingly, a hearing aid, which limits the noise introduced by the battery while being able to adapt to different battery sizes is provided for.

Accordingly, in the following embodiments of a hearing aid 1 having a construction enabling a reduction of the electrical current noise component, without compromising the hearing aids ability to adapt to different battery tolerance will be described.

Figure 2:
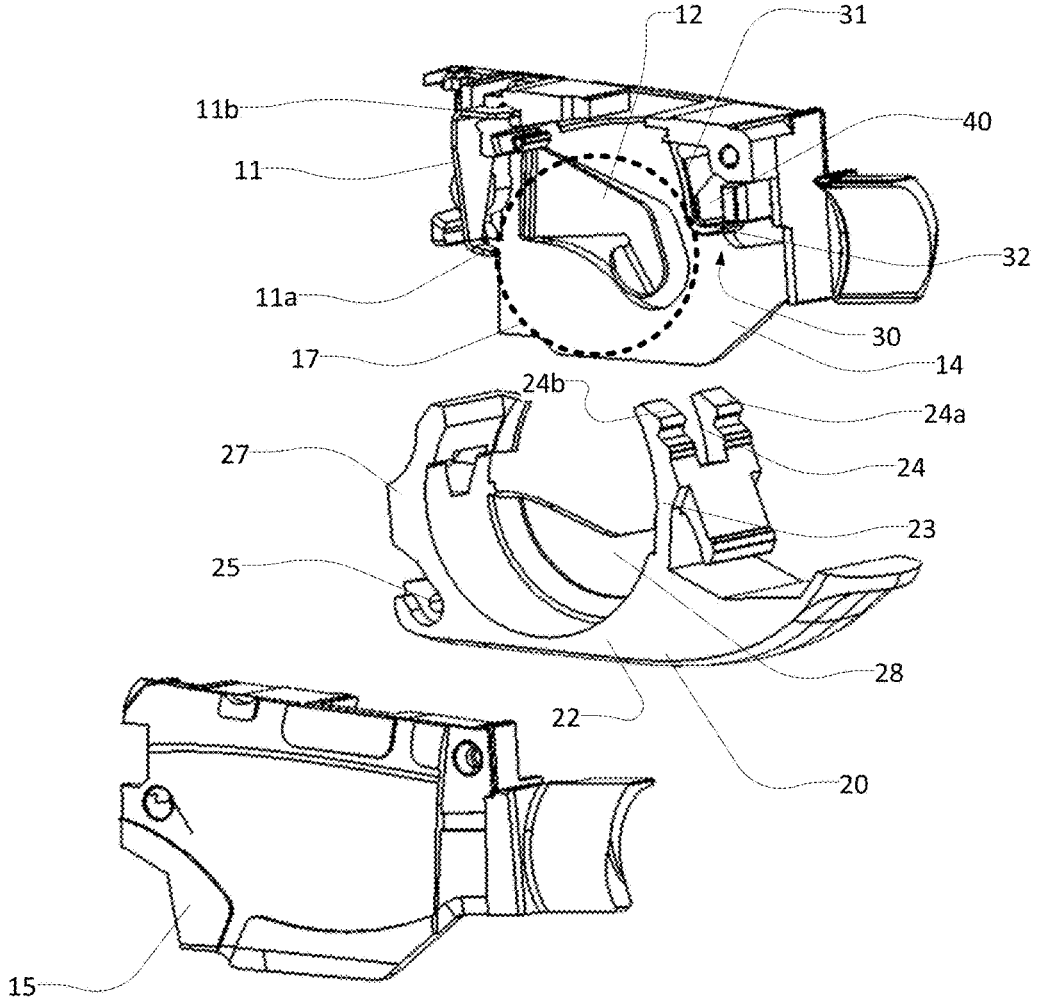
FIG. 2 illustrates an exploded perspective view of a shell structure and a compartment of a hearing aid according to embodiments of the disclosure.

With reference to FIG. 2, an exploded view of a part of a hearing aid 1 according to an embodiment is illustrated. The hearing aid 1 comprises a housing 2 (c.f. FIG. 1) having a first shell structure 14, which is configured to connect with a compartment 20, wherein a battery 5 is received for powering the hearing aid 1. It should be noted, that the first shell structure 14 may be formed as an integrated part of the housing structure or may be a separate shell structure 14 mounted in the housing.

Furthermore, the compartment 20 should be construed as a battery compartment, which is configured to be connected by a pivotal connection to the first shell structure 14. In this way the compartment 20 may be positioned in at least a first closed position and a second open position, where the second open position allows a user to gain access to a battery situated inside the compartment 20. Accordingly, the compartment 20 holds the battery when the battery is inserted therein to connect with the electronic components of the hearing aid.

It should be noted that the compartment 20 should be considered an open battery compartment. By an open battery compartment is should be understood that the compartment 20 comprises two side walls 27, where one may be constituted by a protruding element 23. The two side walls are configured to engage the battery on a rounded side thereof, whereas a wall 28 supports the battery on the flat surface thereof. However, the wall 28 only covers a small part of the extension of the side walls and there is not another side wall, which would support the battery on an opposing side surface to the wall 28. Accordingly, the battery compartment 20 is substantially open allowing for an easy insertion and removal of the battery when in an open position of the compartment 20.

The compartment 20 is connected to the first shell structure 14 through a pivot joint 25 configured for allowing a pivotal movement of the compartment. A center of the compartment 20, defines a center point, with which a center point of the battery is aligned, when the battery is inserted into the compartment.

In more detail, as seen in FIG. 2, the first shell structure 14 comprises a first contact element 11, which first contact element 11 is configured to contact (i.e. abut and touch) a part of the battery in order to power the electronic components of the hearing aid. Accordingly, the first contact element 11 may be understood to form a battery spring or any other element forming an electrical connection to the battery. The contact element 11 of the first shell structure 14 may be designed in any suitable manner creating a small surface area aiming at limiting the noise component transmitted to other electronic components of the hearing aid.

In more detail, the contact element 11 comprises a contact part 11*a* and a guide part 11*b*, where the contact part 11*a*, is configured to make contact with a part of the battery 5 (not shown), and the guide part 11*b* guides the electrical current, created from the contact with the battery 5, towards the internal electronic components of the hearing aid.

When minimizing the contact element 11 in order to minimize the noise component introduced into the hearing aid, the precision tolerances of the battery size is to be taken into account. That is, changing e.g. the contact part 11*a* of the contact element, decreasing the length thereof creates a larger space between the point of contact with the battery and the contact element. Accordingly, for accounting for a size change of the contact element 11, the first shell structure 14 is configured with a flexible compression element 30, which is arranged at an opposite end of the contact element 11 in the shell structure 14. This flexible compression element, as previously described does not act as a contact spring in line with e.g. a battery spring, but aid is creating a force towards the battery so that the battery is pushed towards and kept in a position forcing the battery towards the battery spring (i.e. the contact element) when in a closed position of the battery compartment. Accordingly, it is important that the direction of the force of the flexible compression element is towards the contact element, which is configured on the opposite curved surface of the battery compared to the compression element.

That is, the contact element 11 and the flexible compression element 30 is spaced apart by a free space indicated by the dotted circle 17 in FIG. 2. This free space 17 is configured to receive a battery of the compartment 20. In other words, the battery of the compartment 20 should preferably, when inserted into the hearing aid, fill out the free space between the contact element 11 at one end and the flexible compression element 30 at another end. In this way, the battery 5, when inserted into the compartment 20 will in a closed position at a first point, contact the contact element 11 and at a second point abut the flexible compression element 30, such that the flexible compression element 30 acts on the battery 5 at the second point. In this way, the flexible compression element 30 allows for a smaller contact element 11 construction, since the flexible compression element 30 takes up any tolerances of the battery and potential further tolerances introduced by a change in the contact element 11.

Figure 3:
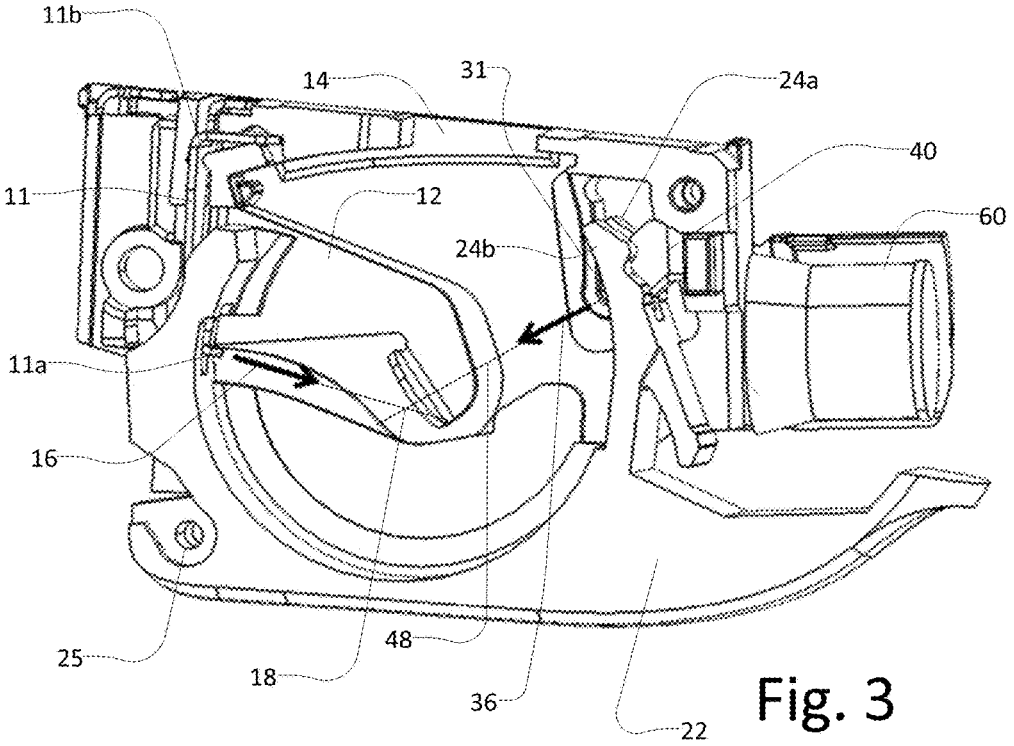
FIG. 3 illustrates an assembled shell structure, compartment and flexible compression element arranged in the shell structure.

In more detail seen in at least FIG. 2 and FIG. 3, the contact element 11 is arranged in the first shell structure 14 in a first end and positioned opposite to the flexible compression element 30, such that the contact element 11 acts on the battery (not shown) with a first force F1 indicated by arrow 16, wherein the flexible compression element 30 acts on the battery with a second force F2 indicated by arrow 36 in order to counteract the first force F1 of the contact element 11. As illustrated in FIG. 3, the two force vectors F1, F2, arising from the contact element 11 and the flexible compression element 30, respectively, interacts at a center point 18 of the free space 17 and accordingly, will interact at a corresponding center point 18 of the battery, thereby counteracting each other making sure that any battery tolerance is taken into account.

In addition to counteracting the force arising from the force vector F1, the construction with the flexible compression element pushing by a force F2 also aids in retaining the battery in the compartment 20 in a closed positions. That is, the force F1 from the contact element, would force the battery out of the compartment, if not counteracted by the F2 from the flexible compression element 30.

Figure 5:
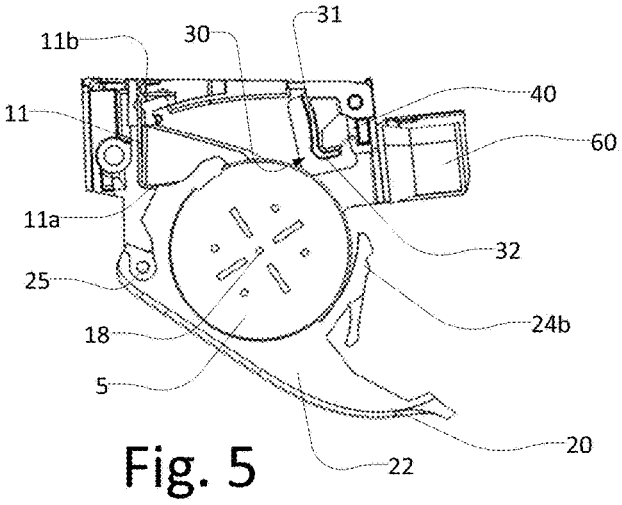
FIG. 5 illustrates a fully open position of the compartment.
Figure 6:
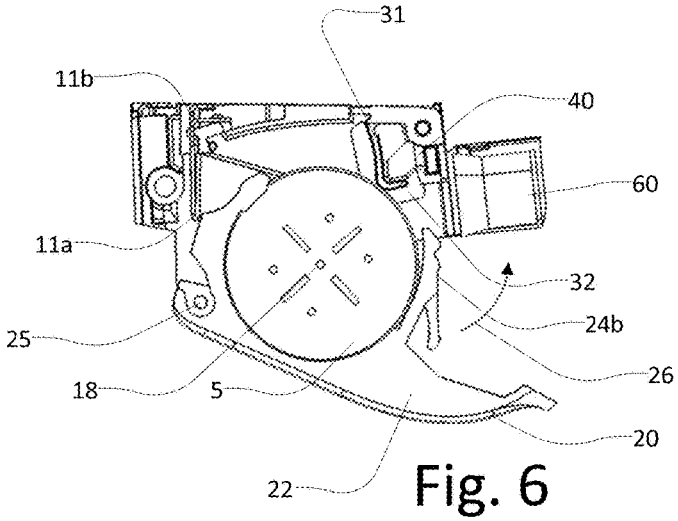
FIG. 6 illustrates the compartment of FIG. 5 in position during a movement from an open to a closed position.
Figure 7:
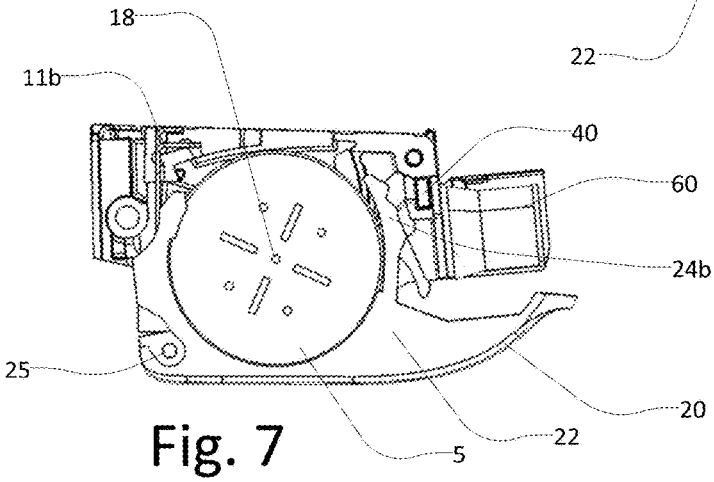
FIG. 7 illustrates the compartment of FIGS. 5 and 6 in a closed position.

Accordingly, when the battery 5 is inserted into the compartment 20 in an open position of the compartment 20 as illustrated in FIG. 5, neither of the contact element 11 or the flexible compression element 30 is in contact with the battery 5. However, upon a closing movement, illustrated by arrow 26 in FIG. 6, of the compartment 20, the battery 5 comes into contact with contact element 11 at one end of the shell structure 14 and the flexible compression element 30 at another end of the shell structure 14. When a closed position of the battery compartment 20, illustrated in FIG. 7, is reached, the flexible compression element 30 entails a force vector F2 (c.f. FIG. 3) extending in a direction towards the battery 5 and the contact element entails a force vector F1 (c.f. FIG. 3) extending in a direction towards the battery, which force vectors F1, F2 counteracts each other to take up any tolerances of the battery.

Accordingly, the contact element 11 creates a force vector F1 in a direction from an end point of the contact element 11 to the center point of the compartment, and the flexible compression element 30 creates a force vector F2 in a direction from an end point of the supporting member to the center point of the compartment 20. Accordingly, the force vectors F1, F2 of the contact element 11 and the flexible compression element 30, respectively, are configured to cancel out each other.

Figure 4:
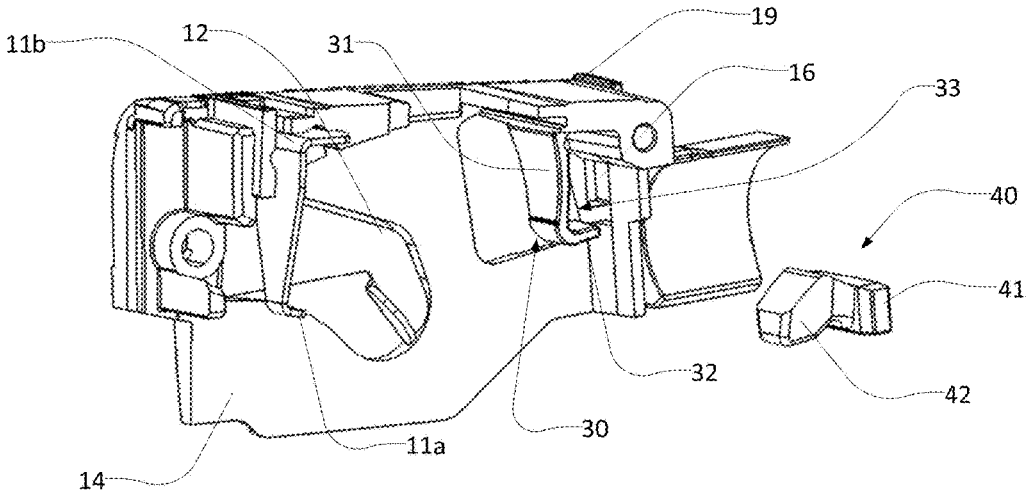
FIG. 4 illustrates a shell structure with the flexible compression element in a partly exploded view.

An exemplary construction of the first shell structure 14 is illustrated in more detail in FIG. 4. As seen, the first shell structure 14 comprises the contact element 11 in one end and the flexible compression element 30 in another end. As illustrated in FIG. 4, the flexible compression element 30 comprises a leg shaped element having a leg portion 31 and a foot portion 32, where the leg element is provided in the first shell structure 14. Furthermore, the flexible compression element 30 comprises a supporting member 40, which is received by the leg element so as to maintain the supporting member 40 in a position inside the shell structure 14 of the housing.

FIG. 4 show an embodiment, where the supporting member 40 and the leg element is in a dissembled configuration. Here it is seen that the leg element, from the foot portion 32 creates a receiving space 33 configured for receiving the supporting member 40. In other words, the supporting member is in an assembled state arranged so that at least a part of the supporting member 40 abut at least a part of the foot portion 32 of the leg element, and is contained in the receiving space 33 defined partly by the foot portion 32.

In more detail, the first shell structure 14 comprises a top surface 19, where the first leg element 31 extends from the top surface 19 in a direction towards the center point or at least the free space 17 of the first shell structure 14 in a substantially L-shaped manner. The foot portion 32 of the leg element extends in a direction substantially parallel with the top surface 19 of the first shell structure 14. That is, the foot portion 32 substantially protrudes from the leg portion 31 with an angle of substantially 90 degrees. In this way, the foot portion 32 extends towards a side part 16 of the first shell structure 14, such that the side part 16 and the foot portion 32 defines the receiving space 33 for the supporting member 40.

In an alternative embodiment, not shown in more detail, it should be understood that the leg element and/or the supporting element could be arranged in the compartment 20 in a similar manner.

Figure 8:
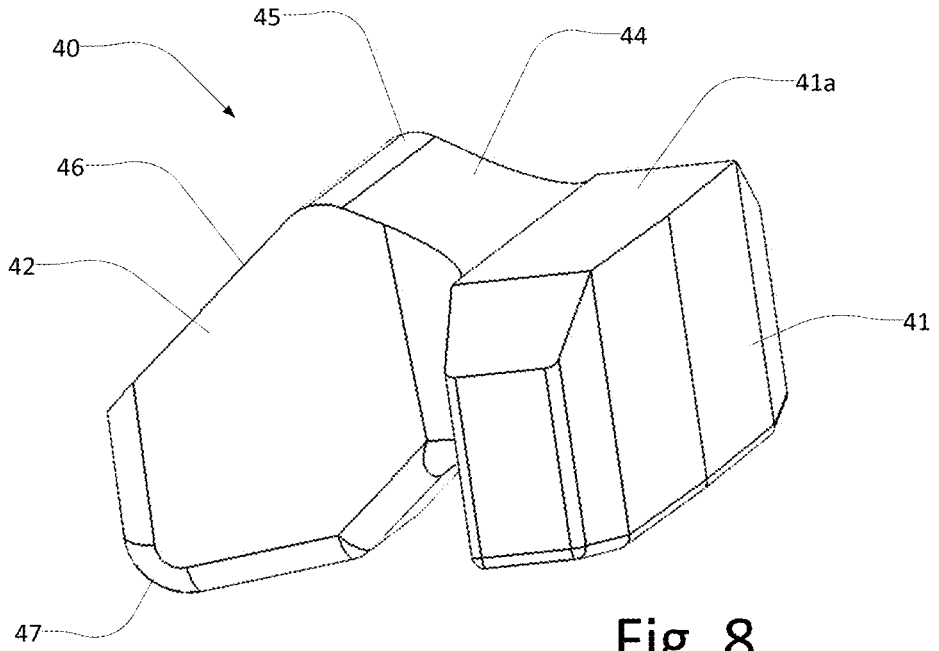
FIGS. 8 and 9 illustrates perspective views of the supporting member according to embodiments of the disclosure
Figure 9:
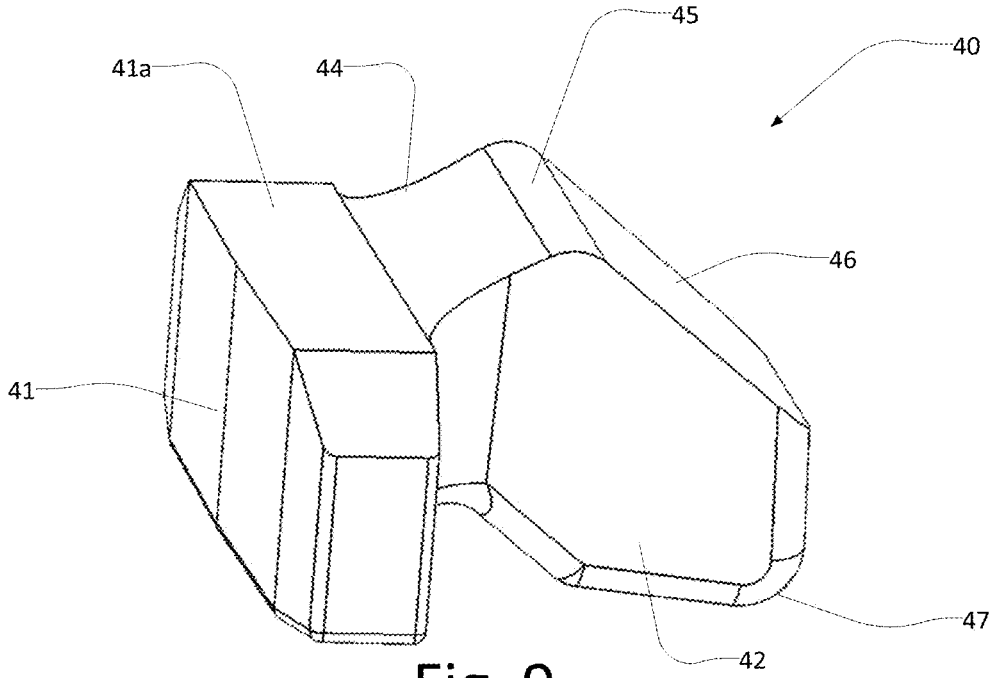

Referring now to FIGS. 8 and 9, the supporting element 40 is shown in more detail. As illustrated, the supporting member 40 comprises a base part 41 and a substantially angled part 42 extending from the base part 40.

The base part 41 is configured to abut the first shell structure at the side surface 16 thereof, and the angled part 42 extends from the base part 41 so as to form an angled protrusion having a centerline extending in a direction towards the center point of the compartment (c.f. FIGS. 3 and 4). The angled part 42 should preferably be constructed such that an imaginary centerline thereof, illustrated as dotted line 48 in FIG. 3, when inserted into the leg element of the flexible compression element 30 passes through and intersects a centerline of the force vector F1 created by force of the contact element acting on the battery (c.f. FIG. 3). With such construction, a best cancellation of the forces is achieved and potential precision tolerances of the battery accounted for.

For the supporting member 40 to provide an efficient counteraction to the force created from the contact element 11, the flexible compression element 30 is preferably made from a material providing a size of the force vector F2 sufficient to cancel out the force vector F1 arising from the at least one contact element. That is, the supporting member 40 may be made from a rubber or silicone material, preferably said material comprises a rubber shore durometer hardness chosen from the range 40 A to 80 A, 40 A to 50 A, 50 A to 60 A or 60 A to 70 A or 70 A to 80 A. The leg part 31, 32 of the flexible compression element 30 may preferably be made of a flexible plastic material.

Accordingly, the supporting member 40 and the leg element of the flexible compression member 30 is able to be compressed upon insertion if the battery in order to take up any tolerances in differences in battery sizes.

As illustrated in FIGS. 8 and 9, the supporting element 40 comprises the base part 41 from which the angled part 42 protrudes in a substantially smooth transition. That is, the angled part 42 protrudes from a top surface 41*a* of the base part 41 with an increasing slope part 44. At a top point 45 of the increasing slope 44, the angled part 42 extends downwards with a decreasing slope part 46, so as to form the angled protruding part of the supporting element 40. It is this decreasing slope 46, which substantially extends towards the center point 18 of the compartment to form a force vector F2 intersecting with the force vector F1 at the center point 18 of the free space 17. A bottom part 47 (i.e. where the decreasing slope 46 substantially ends) is configured to abut the foot portion 32 of the leg element of the flexible compression element 30 (c.f. e.g. FIG. 5).

In order to provide a good connection between the compartment 20 and the shell structure 14, the compartment 20 comprises a bottom surface 22, from which bottom surface 22 a protruding element 23 extends. The protruding element 23 is configured so as to be received in the housing in a closed position of the compartment 20, wherein the protruding element 23 is configured to receive the flexible compression element 30 in an opening 24 provided in the protruding element 23, as illustrated in FIGS. 2 and 3.

In an embodiment, best illustrated in FIGS. 2 and 3, the opening 24 in the protruding element 23 is formed from two substantially leg shaped extensions 24*a*, 24*b*, which are separated a distance from each other so as to be configured to receive the flexible compression element 30 in the opening 24 in a closed position of the compartment 20.

In an embodiment, the hearing aid is furthermore configured with a second contact element 12, also denoted a contact spring configured for contacting a side of the battery so as to power the electronic of the hearing aid. The first contact element 11, as seen on FIG. 2 is configured to engage the battery (not shown) on a rounded surface thereof, and the second contact element 12 is configured to engage the battery on a flat surface area thereof.

Accordingly, the two contact elements 11, 12 are configured to engage with the battery on the plus and minus poles thereof.

In a further embodiment, illustrated in FIG. 3, the hearing aid is furthermore configured with a telecoil 60, which is arranged in the shell structure 14. In more detail, the telecoil 60 is arranged in the shell structure 14 at an end opposite to the first contact element 11, where a coil element axis runs substantially parallel with a longitudinal centerline of the first 11 and second contact element 12. By this configuration, the current running through the hearing aid, when the battery is in contact with the contact elements, has limited influence of the telecoil.

As seen in the Figures, the hearing aid may in one embodiment further comprises a second shell structure 15, which is configured to be assembled with the first shell structure 14. This second shell structure 15 may form part of the housing by being integrated into the structure of the housing of the hearing aid or e.g. be an independent part which is mounted in the hearing aid housing structure.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing device comprising:

a housing having at least a first shell structure;

a battery compartment configured to be arranged in a pivotal connection with said at least first shell structure, wherein said battery compartment having a center point is configured to receive and house a battery for powering said hearing device; and at least a first contact element and a second contact element configured to contact said battery when said battery is received in said battery compartment and moved into a closed position of said battery compartment, said first and second contact elements engaging the battery on a plus and minus pole thereof so as to transmit power to the electronic of the hearing device, wherein said hearing device further comprises a flexible compression element provided in connection with said at least first shell structure and/or in connection with said battery compartment and configured to act on said battery when said compartment is moved from an open to a closed position, wherein the flexible compression element is made from a plastic material, wherein the flexible compression element creates a force vector acting on a curved surface of the battery, and wherein the curved surface of the battery is substantially opposite to a second curved surface of the battery to which the contact element contacts the battery.

2. Hearing device according to claim 1, wherein said flexible compression element comprises a leg element provided in said first shell structure or in said compartment, and a supporting member, wherein said leg element is configured to receive said supporting member so as to maintain the supporting member in a position inside said housing.

3. Hearing device according to claim 1, wherein said first contact element is arranged in said first shell structure in a first end positioned opposite to said flexible compression element, said first contact element acting on said battery with a force (F1), wherein said flexible compression element is configured to counteract said first force (F1).

4. Hearing device according to claim 2, wherein said first shell structure comprises a top surface, where said first leg element extends from said top surface in a direction towards said center point of said compartment in a substantially L-shaped manner.

5. Hearing device according to claim 1, wherein said first contact element creates a force vector F1 in a direction from an end point of said contact element to the center point of said battery compartment, and said flexible compression element creates a force vector F2 in a direction to the center point of said compartment, wherein the force vectors F1, F2 of said first contact element and said flexible compression element, respectively, are configured to cancel out each other.

6. Hearing device according to claim 5, wherein the flexible compression element is made from a material providing a size of said force vector F2 sufficient to cancel out said force vector F1 arising from said first contact element.

7. Hearing device according to claim 1, wherein the supporting member is made from a rubber or silicone material, preferably said material comprises a rubber shore durometer hardness chosen from the range 40A to 80A, 40A to 50A, 50A to 60A or 60A to 70A or 70A to 80A.

8. Hearing device according to claim 1, wherein said battery compartment comprises a bottom surface, from which bottom surface a protruding element extends so as to be received in said housing in a closed position of the compartment, wherein the protruding element is configured to receive said flexible compression element in an opening provided in said protruding element.

9. Hearing device according to claim 2, wherein said at least first shell structure comprises a side structure, which side structure abuts a second end of said supporting member, wherein said first end of said supporting member is arranged to abut a part of said leg element.

10. Hearing device according to claim 2, wherein said supporting member comprises a base part and a substantially angled part extending from said base part.

11. Hearing device according to claim 10, wherein said base part is configured to abut said side structure of said shell structure, and said angled part extends from said base part so as to form an angled protrusion having a centerline extending in a direction towards the center point of said compartment.

12. Hearing device according to claim 8, wherein said opening in said protruding element is formed from two substantially leg shaped extensions, which are separated a distance from each other so as to be configured to receive said flexible compression element in said opening in a closed position of said compartment.

13. Hearing device according to claim 1 further comprising a second contact element, wherein said first contact element is configured to engage said battery in a rounded surface thereof, and said second contact element is configured to engage said battery at a flat surface area thereof.

14. Hearing device according to claim 1, wherein a coil element is arranged in said shell structure at an end opposite to said first contact element, where a coil element axis runs substantially parallel with a longitudinal centerline of first and second contact element.

15. Hearing device according to claim 2, wherein said first contact element is arranged in said first shell structure in a first end positioned opposite to said flexible compression element, said first contact element acting on said battery with a force (F1), wherein said flexible compression element is configured to counteract said first force (F1).

16. Hearing device according to claim 2, wherein said first contact element creates a force vector F1 in a direction from an end point of said contact element to the center point of said battery compartment, and said flexible compression element creates a force vector F2 in a direction from an end point of said supporting member to the center point of said compartment, wherein the force vectors F1, F2 of said first contact element and said flexible compression element, respectively, are configured to cancel out each other.

17. Hearing device according to claim 3, wherein said first contact element creates a force vector F1 in a direction from an end point of said contact element to the center point of said battery compartment, and said flexible compression element creates a force vector F2 in a direction to the center point of said compartment, wherein the force vectors F1, F2 of said first contact element and said flexible compression element, respectively, are configured to cancel out each other.

18. Hearing device according to claim 4, wherein said first contact element creates a force vector F1 in a direction from an end point of said contact element to the center point of said battery compartment, and said flexible compression element creates a force vector F2 in a direction from an end point of said supporting member to the center point of said compartment, wherein the force vectors F1, F2 of said first contact element and said flexible compression element, respectively, are configured to cancel out each other.

19. Hearing device according to claim 16, wherein the flexible compression element is made from a material providing a size of said force vector F2 sufficient to cancel out said force vector F1 arising from said first contact element.

20. Hearing device according to claim 17, wherein the flexible compression element is made from a material providing a size of said force vector F2 sufficient to cancel out said force vector F1 arising from said first contact element.

* * * * *